US008670688B2

(12) United States Patent
Ueno et al.

(10) Patent No.: US 8,670,688 B2
(45) Date of Patent: Mar. 11, 2014

(54) DEVELOPING CARTRIDGE AND PROCESS CARTRIDGE WITH GRIP PORTION OF SEALING MEMBER PREVENTING MOUNTING OF CARTRIDGE

(75) Inventors: Takahito Ueno, Mishima (JP); Tetsuya Numata, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 253 days.

(21) Appl. No.: 12/907,238

(22) Filed: Oct. 19, 2010

(65) Prior Publication Data

US 2011/0103823 A1 May 5, 2011

(30) Foreign Application Priority Data

Oct. 30, 2009 (JP) ..... 2009-249750

(51) Int. Cl.
*G03G 15/08* (2006.01)

(52) U.S. Cl.
USPC ..... 399/106

(58) Field of Classification Search
USPC ..... 399/103, 106, 119, 262; 222/465.1
See application file for complete search history.

(56) References Cited

U.S. PATENT DOCUMENTS 5,937,237 A * 8/1999 Nonaka et al. ..... 399/106
6,385,416 B1 5/2002 Horikawa et al.
6,608,980 B2 8/2003 Murayama et al.
6,714,752 B2 3/2004 Ueno et al.
6,804,476 B2 * 10/2004 Yokoi et al. ..... 399/27
6,823,153 B2 11/2004 Ueno et al.
6,829,455 B2 12/2004 Yasumoto et al.
6,834,171 B2 12/2004 Nittani et al.
6,834,175 B2 12/2004 Murayama et al.
6,898,391 B2 5/2005 Numagami et al.
6,912,365 B2 6/2005 Ueno et al.

(Continued)

FOREIGN PATENT DOCUMENTS

JP 2000131943 A * 5/2000
JP 2002-278417 * 9/2002

(Continued)

OTHER PUBLICATIONS

Office Action in Chinese Patent Application No. 201010529813.1, mailed Mar. 31, 2012.

*Primary Examiner* — Robert Beatty
(74) *Attorney, Agent, or Firm* — Fitzpatrick, Cella, Harper & Scinto

(57) ABSTRACT

A developing cartridge is detachably mountable to a main assembly of an image forming apparatus by passing through a mounting guide provided in the main assembly. The developing cartridge includes a frame; a developer carrying member for carrying a developer for developing an electrostatic latent image; a portion to be guided for being guided by the mounting guide when the developing cartridge passes through the mounting guide; an accommodating portion for accommodating the developer; a seal member for unsealably sealing an opening for permitting supply of the developer from the accommodating portion to the developer carrying member; and a grip member, provided at a longitudinal end portion of the seal member, including a fixed portion dismountably fixed on the frame and a grip portion to be gripped when the seal member is removed. The grip portion is disposed in a state in which the grip portion is bent relative to the fixed portion in a direction crossing a mounting direction of the developing cartridge. The grip portion prevents mounting of the developing cartridge by contacting a part of the image forming apparatus when the developing cartridge is mounted in the main assembly of the image forming apparatus.

22 Claims, 10 Drawing Sheets

(56) References Cited

U.S. PATENT DOCUMENTS

| | | | |
|---|---|---|---|
| 6,954,600 | B2 | 10/2005 | Fujita et al. |
| 6,954,601 | B2 | 10/2005 | Numagami et al. |
| 6,968,146 | B1 | 11/2005 | Fujita et al. |
| 6,970,668 | B2 | 11/2005 | Ueno et al. |
| 6,978,099 | B2 | 12/2005 | Ueno et al. |
| 7,003,247 | B2 | 2/2006 | Koishi et al. |
| 7,062,200 | B2 | 6/2006 | Ueno et al. |
| 7,092,658 | B2 | 8/2006 | Yasumoto et al. |
| 7,139,502 | B2 | 11/2006 | Koishi et al. |
| 7,158,749 | B2 | 1/2007 | Ueno et al. |
| 7,164,875 | B2 | 1/2007 | Miyabe et al. |
| 7,174,122 | B2 | 2/2007 | Fujita et al. |
| 7,184,690 | B2 | 2/2007 | Ueno et al. |
| 7,206,534 | B2 | 4/2007 | Murakami |
| 7,209,682 | B2 | 4/2007 | Numagami et al. |
| 7,248,810 | B2 | 7/2007 | Miyabe et al. |
| 7,315,710 | B2 | 1/2008 | Ueno et al. |
| 7,366,452 | B2 | 4/2008 | Fujita et al. |
| 7,440,715 | B2 | 10/2008 | Numagami et al. |
| 7,450,877 | B2 | 11/2008 | Miyabe et al. |
| 7,457,566 | B2 | 11/2008 | Koishi et al. |
| 7,483,646 | B2 | 1/2009 | Ueno et al. |
| 7,630,665 | B2 | 12/2009 | Ueno et al. |
| 7,702,251 | B2 | 4/2010 | Miyabe et al. |
| 7,720,408 | B2 | 5/2010 | Ueno et al. |
| 7,813,668 | B2 | 10/2010 | Ueno et al. |
| 2002/0067930 | A1 * | 6/2002 | Oguma et al. ..... 399/222 |
| 2008/0152388 | A1 | 6/2008 | Ueno et al. |
| 2008/0260428 | A1 | 10/2008 | Ueno et al. |
| 2008/0286000 | A1 | 11/2008 | Kimizuka et al. |
| 2009/0317134 | A1 | 12/2009 | Miyabe et al. |
| 2009/0317135 | A1 | 12/2009 | Miyabe et al. |
| 2010/0054796 | A1 | 3/2010 | Nakamura et al. |
| 2010/0054804 | A1 | 3/2010 | Uneme et al. |
| 2010/0054805 | A1 | 3/2010 | Numata et al. |
| 2010/0054806 | A1 | 3/2010 | Ueno et al. |
| 2010/0054807 | A1 | 3/2010 | Takeyama et al. |
| 2010/0054823 | A1 | 3/2010 | Takasaka et al. |
| 2010/0158556 | A1 | 6/2010 | Miyabe et al. |

FOREIGN PATENT DOCUMENTS

| | | | |
|---|---|---|---|
| JP | 2002278417 | A * | 9/2002 |
| JP | 2003-241495 | | 8/2003 |
| JP | 2005-242255 | | 9/2005 |
| JP | 2006-330427 | | 12/2006 |
| JP | 2008191572 | A * | 8/2008 |

* cited by examiner

DEVELOPING CARTRIDGE AND PROCESS CARTRIDGE WITH GRIP PORTION OF SEALING MEMBER PREVENTING MOUNTING OF CARTRIDGE

FIELD OF THE INVENTION AND RELATED ART

The present invention relates to a developing cartridge and a process cartridge which are detachably mountable to an electrophotographic image forming apparatus.

Here, the electrophotographic image forming apparatus forms an image on a recording material (medium) by using an electrophotographic image forming process. For example, the image forming apparatus includes an electrophotographic copying machine, an electrophotographic printer (such as an LED printer or a laser beam printer), an electrophotographic facsimile machine, an electrophotographic word processor, and the like.

The developing cartridge integrally holds, as process means actable on an electrophotographic photosensitive member, at least a developing means and is to be mounted into and demounted from a main assembly of the electrophotographic image forming apparatus.

Further, the developing cartridge can be mounted into and demounted from the apparatus main assembly by a user himself (herself). Therefore, maintenance of the apparatus can be performed by the user without relying on a service person. As a result, a maintenance operation of the image forming apparatus is improved.

In a conventional image forming apparatus using the electrophotographic image forming process, a cartridge type in which an image bearing member and the process means actable on the image bearing member are integrally assembled into a cartridge which is detachably mountable to the image forming apparatus has been employed. According to this cartridge type, the maintenance of the apparatus was able to be performed by the user himself (herself) without relying on the service person, so that operativity was able to be remarkably improved. Therefore, the cartridge type has been used widely in the image forming apparatus.

By the cartridge type, the operativity was further improved, so that it became possible to easily perform the maintenance of the electrophotographic image forming apparatus by the user himself (herself). For that reason, the image forming apparatus of the cartridge type has been used widely.

Many cartridges employ a toner seal member for hermetically sealing an opening of a toner accommodating portion in order to prevent toner leakage at the time of shipment. Further, before the cartridge is mounted in the image forming apparatus, the toner seal member is pulled off to place the toner in the toner accommodating portion in a feedable state and then is mounted in the image forming apparatus in the feedable state.

The toner seal member has to be removed when the cartridge is mounted in the image forming apparatus. For that reason, in the case where the user will mount the cartridge in the image forming apparatus without removing the toner seal member, there is a need to cause the user to easily recognize that the toner seal member has not been removed.

For that purpose, Japanese Laid-Open Patent Application (JP-A) 2002-278417 has proposed that a seal grip member fixed at one end of a toner seal member is largely projected from a side surface of the cartridge or is provided with a stopper for preventing bending thereof even when the user intends to bend the seal grip member.

However, in JP-A 2002-278417, the full length of the cartridge becomes long and the presence of the seal grip member causes an increase in size of an individual packaging box for packing the cartridge at the time of shipment, thus being directly linked to an increase in transportation cost.

Further, it would be considered that the cartridge can be packed in a state in which the seal grip member is bent by utilizing its elasticity. However, even in that case, it is difficult to retain the bent state during the packing in a manufacturing process and further an attitude of the seal grip member in a packed state cannot be controlled. For this reason, there was a possibility that detachment of the seal grip member from a container, deformation of the seal grip member, and the like are caused.

In order to realize downsizing of the individual packaging box and in order to take measures against the detachment, the deformation and breakage of the seal grip member in the packed state, it is essential to not only downsize the cartridge itself but also employ a constitution in which the seal grip member fixed at one end of the toner seal member is prevented from being projected from the full-length portion of the cartridge.

At that time, there is a possibility that visibility of the seal grip member becomes poor, so that there is a possibility that the cartridge is mounted in the image forming apparatus without removing the toner seal member. For that reason, even in the case where the toner seal member is not removed, there is a need to cause the cartridge to interfere with the main assembly of the image forming apparatus to prevent the mounting of the cartridge.

SUMMARY OF THE INVENTION

A principal object of the present invention is to provide a developing cartridge and a process cartridge which allow a user to easily recognize that a seal member is not removed even in the case where a grip member fixed at an end of the seal member is accommodated within a full length of the cartridge.

According to an aspect of the present invention, there is provided a developing cartridge detachably mountable to a main assembly of an image forming apparatus by passing through a mounting guide provided in the main assembly, the developing cartridge comprising:

a frame;

a developer carrying member for carrying a developer for developing an electrostatic latent image;

a portion to be guided for being guided by the mounting guide when the developing cartridge passes through the mounting guide;

an accommodating portion for accommodating the developer;

a seal member for unsealably sealing an opening for permitting supply of the developer from the accommodating portion to the developer carrying member; and a grip member, provided at a longitudinal end portion of the seal member, including a fixed portion dismountably on the frame and a grip portion to be gripped when the seal member is removed, wherein the grip portion is disposed in a state in which the grip portion is bent relative to the fixed portion in a direction crossing a mounting direction of the developing cartridge, and wherein the grip portion prevents mounting of the developing cartridge by contacting a part of the image forming apparatus when the developing cartridge is mounted in the main assembly of the image forming apparatus.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

As one form for carrying out the present invention, embodiments of a so-called rotary type color electrophotographic image forming apparatus including a rotary in which a plurality of developing cartridges is mountable will be described with reference to the drawings.

[First Embodiment]

(General structure of color electrophotographic image forming apparatus)

First, a constitution and an image forming operation of the color electrophotographic image forming apparatus in which the developing cartridges are mounted and an image is formed will be described.

Figure 1:
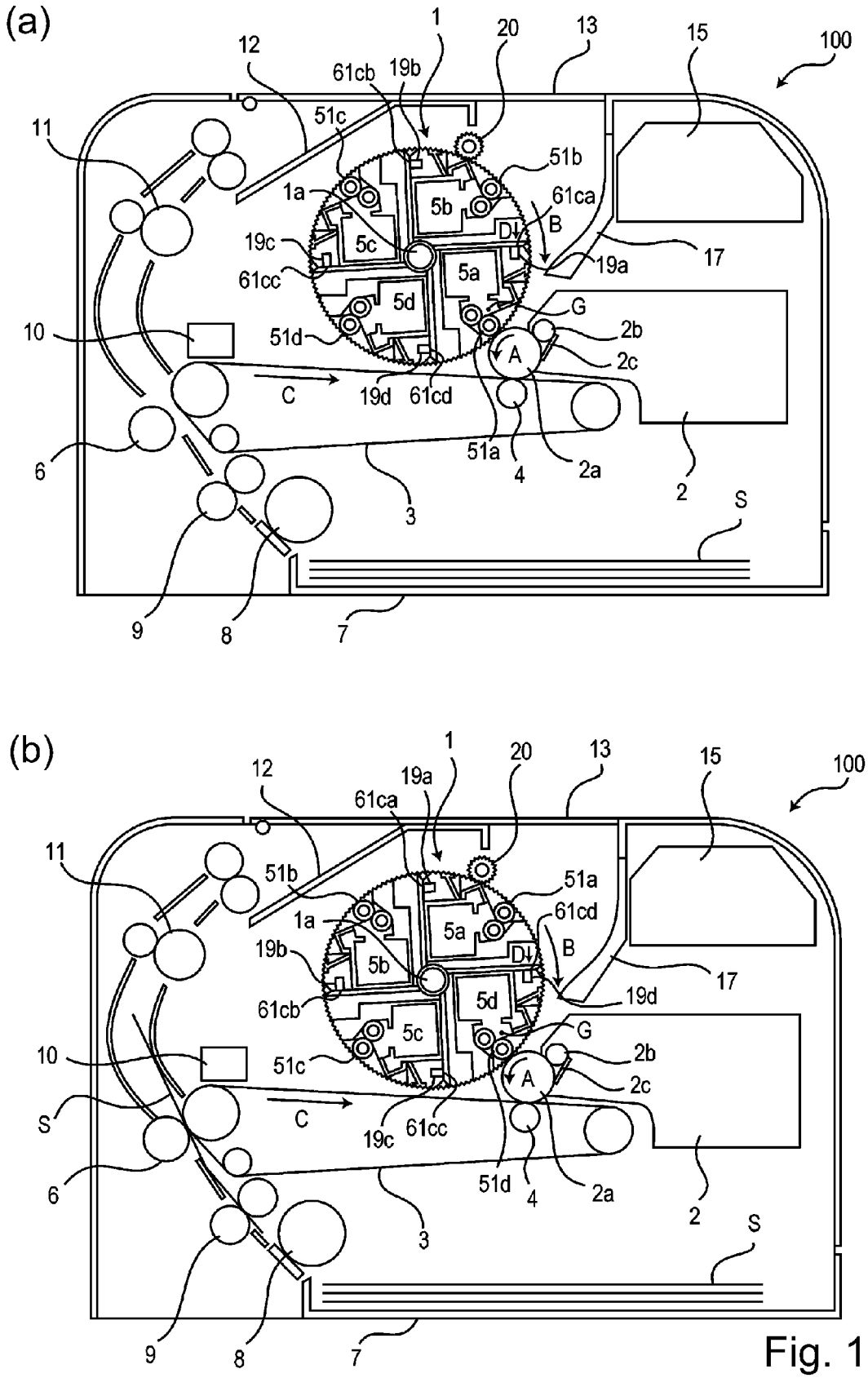
FIGS. 1(*a*) and 1(*b*) are schematic sectional views showing an example of an image forming apparatus main assembly during development in an embodiment of the present invention.

The color electrophotographic image forming apparatus in this embodiment of the present invention is a four color-based full-color laser beam printer. FIG. 1(*a*) is a sectional view showing a schematic structure of the image forming apparatus during a developing operation of a yellow developing cartridge 5*a*. FIG. 1(*b*) is a sectional view showing a schematic structure of the image forming apparatus during the developing operation of a black developing cartridge 5*d*.

As shown in FIG. 1(*a*), an image forming apparatus 100 includes a photosensitive drum 2*a*. At a periphery of the photosensitive drum 2*a*, a charging means 2*b* (charging roller in this embodiment) for uniformly charging the photosensitive drum 2*a* and an exposure means 15 for forming a latent image (electrostatic image) on the photosensitive drum 2*a* by irradiating the surface of the photosensitive drum 3*a* with laser light are disposed. Further, the image forming apparatus 100 includes a plurality of developing cartridges 5 (5*a* to 5*d*) each for developing the latent image formed on the photosensitive drum 2*a* with toner of an associated color. The plurality of developing cartridges 5 refers to a yellow developing device 5*a*, a magenta developing device 5*b*, a cyan developing device 5*c* and a black developing device 5*d*. Further, a cleaning means 2*c* for removing residual toner on the photosensitive drum 2*a* is disposed.

In this embodiment, the photosensitive drum 2*a*, the charging means 2*b* and the cleaning means 2*c* are integrally constituted and are assembled into a drum cartridge 2, which is detachably mountable to the image forming apparatus 100 and is employed.

A rotary 1 is constituted rotatably about a rotational axis (rotation shaft) 1*a* and holds the yellow developing cartridge 5*a*, the magenta developing cartridge 5*b*, the cyan developing cartridge 5*c* and the black developing cartridge 5*d* in the same attitude. The rotary 1 has the same developing cartridge holding constitution with respect to all the developing cartridges 5*a* to 5*d*.

When the developing cartridges 5 are mounted in the rotary 1, portions to be locked 61*c* (61*ca* to 61*cd*) engage with developing cartridge locking members 19 (19*a* to 19*d*) provided in the rotary 1. Each of the locking members 19 is urged by a spring (not shown) in a direction (indicated by an arrow D) in which the locking member 19 engages with the developing cartridge 5. As a result, detachment of the developing cartridge 5 from the rotary 1 is suppressed.

Here, the rotary 1 is attached to a main assembly frame in a state in which the rotary 1 holds the developing cartridges 5. In this embodiment, the developing cartridges 5 are mountable into and demountable from the rotary 1 with respect to a radial direction of the rotary 1.

During image formation, the photosensitive drum 2*a* is rotated in a counterclockwise direction indicated by an arrow A in FIG. 1(*a*) in synchronism with rotation of an intermediary transfer belt 3 in a direction indicated by an arrow C in FIG. 1(*a*). Then, the surface of the photosensitive drum 2*a* is uniformly charged by the charging means 2*b* and at the same time is irradiated with light for a yellow image by the exposure means 15, so that an electrostatic latent image for yellow is formed on the photosensitive drum 2*a*.

In synchronism with this formation of the electrostatic latent image, the rotary 1 is rotated about a rotary rotational axis (rotation shaft) 1*a* in the clockwise direction indicated by an arrow B in FIG. 1(*a*) by a drive transmission mechanism provided in the image forming apparatus 100. By the rotation of the rotary 1, the yellow developing cartridge 5*a* is disposed at a developing position in which the yellow developing cartridge 5*a* opposes the photosensitive drum 2*a* (FIG. 1(*a*)), Then, a voltage of an identical polarity to a charge polarity of the photosensitive drum 2*a* is applied to a developing roller 51*a* so that a yellow developer is deposited on the latent image formed on the photosensitive drum 2*a*. As a result, the latent image formed on the photosensitive drum 2*a* is developed by depositing the yellow developer thereon. That is, a yellow developer image is formed on the photosensitive drum 2*a*.

Thereafter, by applying a voltage of an opposite polarity to the toner charge polarity to a primary transfer roller 4 disposed inside the intermediary transfer belt 3, the yellow toner image is primary-transferred from the photosensitive drum 2*a* on to the intermediary transfer belt 3.

In the above-described manner, when the primary transfer of the yellow toner image is completed, the rotary 1 is rotationally moved in the arrow B direction in FIG. 1(*a*) by receiving a driving force from the drive transmission mechanism of the image forming apparatus 100. Then, the magenta developing cartridge 5*b*, the cyan developing cartridge 5*c* and the black developing cartridge 5*d* are successively positioned at the developing position in which the positioned developing cartridge opposes the photosensitive drum 2*a*.

Similarly as in the case of yellow, with respect to each of the colors of magenta, cyan and black, the formation of the electrostatic latent image, the development of the electrostatic latent image and the primary transfer are successively performed, so that four color toner images are superposed on the intermediary transfer belt 3.

During this image forming operation, as shown in FIG. 1(*a*), a secondary transfer roller 6 is in non-contact with the intermediary transfer belt 3. Further, at that time, a cleaning unit 10 for the intermediary transfer belt 3 is also in non-contact with the intermediary transfer belt 3.

On the other hand, sheets S which are a recording material (medium) for the toner images are stacked and accommodated in a sheet feeding cassette 7 provided at a lower portion of the image forming apparatus 100 and are separated and fed one by one from the sheet feeding cassette 7 by a sheet feeding roller 8, thus being fed to a registration roller pair 9. The registration roller pair 9 sends the fed sheet S between the intermediary transfer belt 3 and the secondary transfer roller 6. Here, as shown in FIG. 1(*b*), the secondary transfer roller 6 is in a state in which it press-contacts the intermediary transfer belt 13.

Further, the voltage of the opposite polarity to the toner charge polarity has been applied to the secondary transfer roller 6, so that the above-described four color toner images superposed on the intermediary transfer belt 3 are collectively secondary-transferred onto the surface of the conveyed sheet S.

The sheet S on which the toner images are transferred is sent to a fixing device 11. In the fixing device 11, the sheet S is heated and pressed, so that the toner images are fixed on the sheet S. As a result, an image is formed on the sheet Sm and then the sheet S is discharged from the fixing device 11 to a sheet discharge portion of an upper cover 12 of the image forming apparatus 100.

(Developing Cartridge Constitution)

Next, the developing cartridges 5 will be described. With respect to the developing cartridges 5, all the constitutions of the yellow developing cartridge 5*a*, the magenta developing cartridge 5*b*, the cyan developing cartridge 5*c* and the black developing cartridge 5*d* are the same. Therefore, the description of the constitutions of the respective developing cartridges 5*a* and 5*d* will be made with respect to the developing cartridge 5. The developing cartridge 5 will be described with reference to FIGS. 2(*a*), 2(*b*) and 3.

Figure 2:
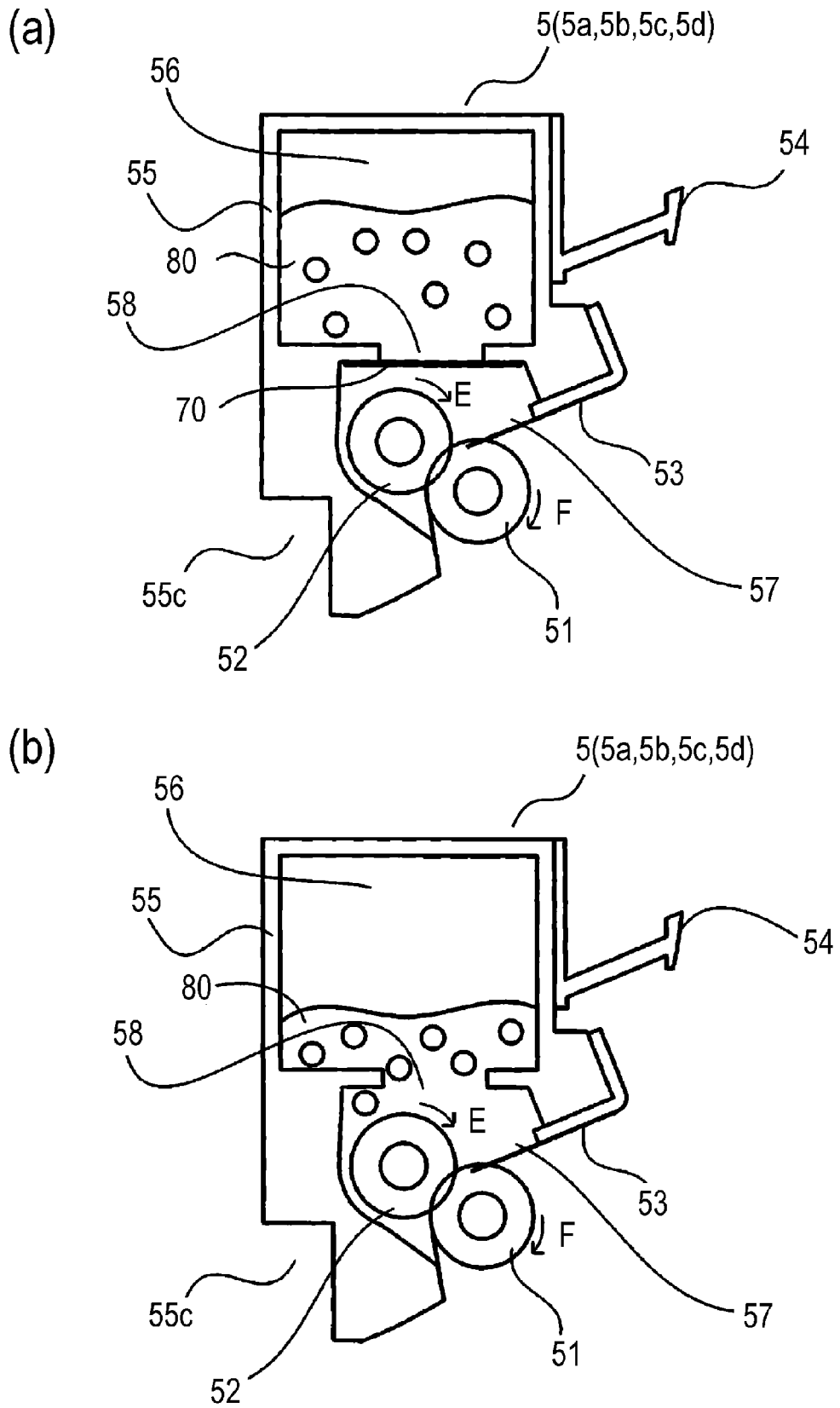
FIGS. 2(*a*) and 2(*b*) are schematic sectional views of a developing cartridge according to the embodiment of the present invention.
Figure 3:
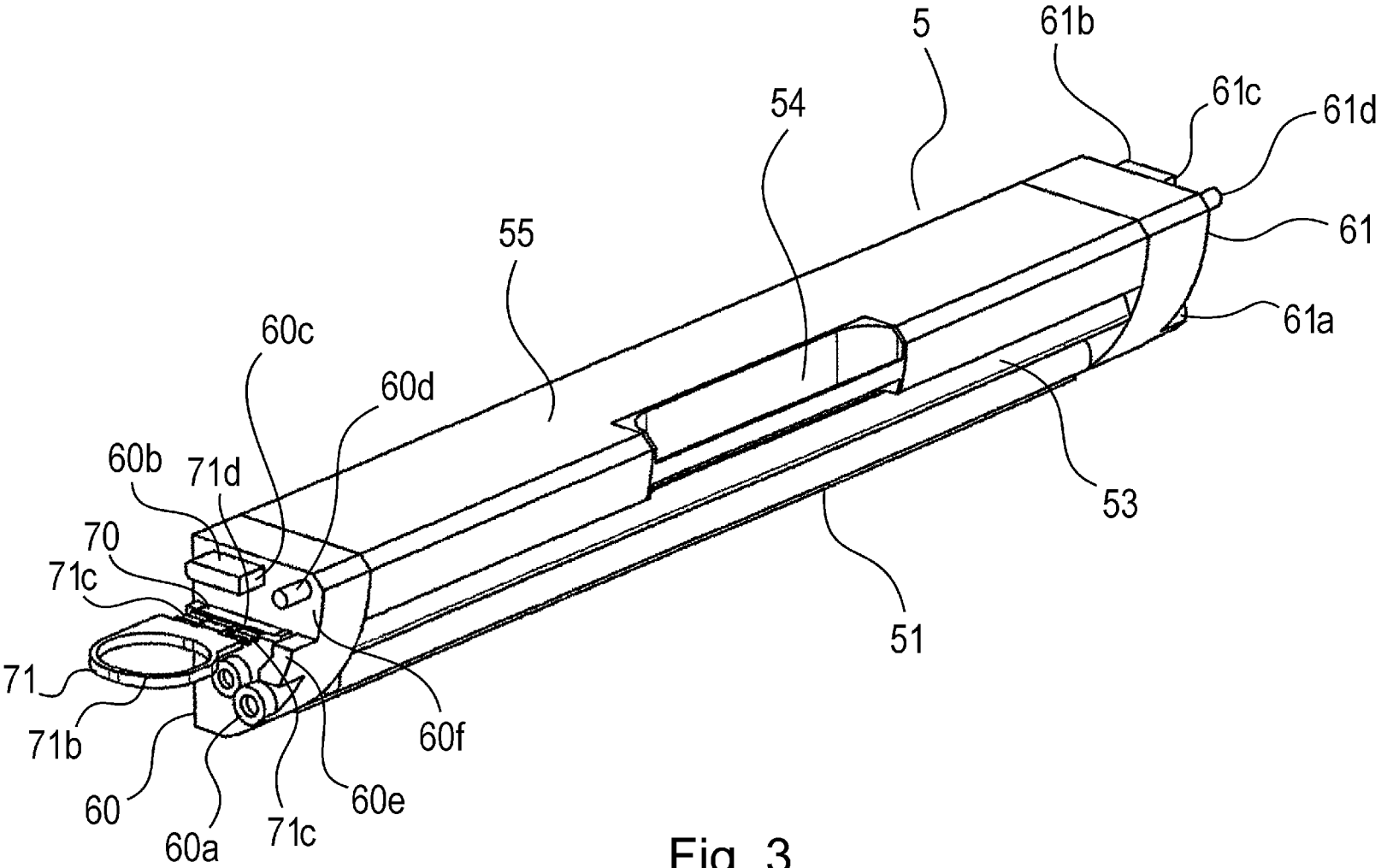
FIG. 3 is a schematic perspective view showing the developing cartridge according to the embodiment of the present invention.

FIG. 2(*a*) is a sectional view of the developing cartridge 5 in this embodiment before a toner seal is pulled out. FIG. 2(*b*) is a sectional view of the developing cartridge 5 in this embodiment after the toner seal is pulled out. FIG. 3 is a schematic perspective view of the developing cartridge 5 in this embodiment.

A developing device (cartridge) frame 55 of the developing cartridge 5 is separated into a toner accommodating chamber (portion) 56 accommodating the toner and a developing chamber 57 including a developing roller 51 and a toner feeding rotary 52. The both chambers 56 and 57 are vertically divided by a toner feeding (supply) opening 58.

In an unused state until the developing cartridge 5 is delivered to the user, as shown in FIG. 2(*a*), at the toner feeding opening 58, a toner seal 70 for separating the toner accommodating chamber 56 and the developing chamber 57 by sealing the opening is fixed. This toner seal 70 is a film-like seal member and unsealably seals the toner feeding opening 58 by a method such as welding. By removing the toner seal 70 before use of the developing cartridge 5, toner 80 in the toner accommodating chamber 56 falls freely into the developing chamber 57 toward a developing position in which the developing cartridge 5 opposes the photosensitive drum as shown in FIG. 2(*b*).

The toner in the developing chamber 57 is fed to the toner feeding roller 52. Further, the toner feeding roller 52 feeds the toner to the developing roller 51 which is developer carrying member by rotating in a clockwise direction indicated by an arrow E. The developing roller 51 is constituted by an elastic rubber roller and rotates in a direction indicated by an arrow F. The toner on the surface of the developing roller 51 is regulated by a developing blade 53 so as to have a constant thickness and is subjected to development on the photosensitive drum 2*a* at the developing position.

After the developing operation, the toner left on the surface of the developing roller 51 is removed by the toner feeding roller 52. Thereafter, the toner is fed again to the developing roller 51 by the toner feeding roller 52.

Further, at the developing position, in order to stably bring the developing roller 51 into contact with the photosensitive drum 2*a*, the developing roller 51 is urged together with the rotary 1 in a direction of the photosensitive drum 2*a*. As a result, the developing roller 51 of the developing cartridge 5 (the developing roller 51*a* of the yellow developing cartridge 5*a* in FIG. 1(*a*)) is in a state in which the developing roller 51 contacts the photosensitive drum 2*a* with a predetermined urging force.

At this time, the rotary 1 which holds the developing cartridge 5 is swingable about a rotary driving shaft (axis) 20 (FIG. 1(*a*)) and is urged as a whole in the direction of the photosensitive drum 2*a* by an urging means (not shown), so that the developing roller 51*a* contacts the photosensitive drum 2*a* with a predetermined pressure.

<Mounting and Demounting Constitution of Developing Cartridge with Respect to Image Forming Apparatus Main Assembly>

Next, a mounting and demounting constitution of the developing cartridge 5 with respect to the image forming apparatus 100 will be described with reference to FIGS. 4(*a*) and 4(*b*) by taking the case where the yellow developing cartridge 5*a* is mounted and demounted as an example. Incidentally, mounting and demounting constitutions of other developing cartridges are identical to that of the yellow developing cartridge 5*a*.

Figure 4:
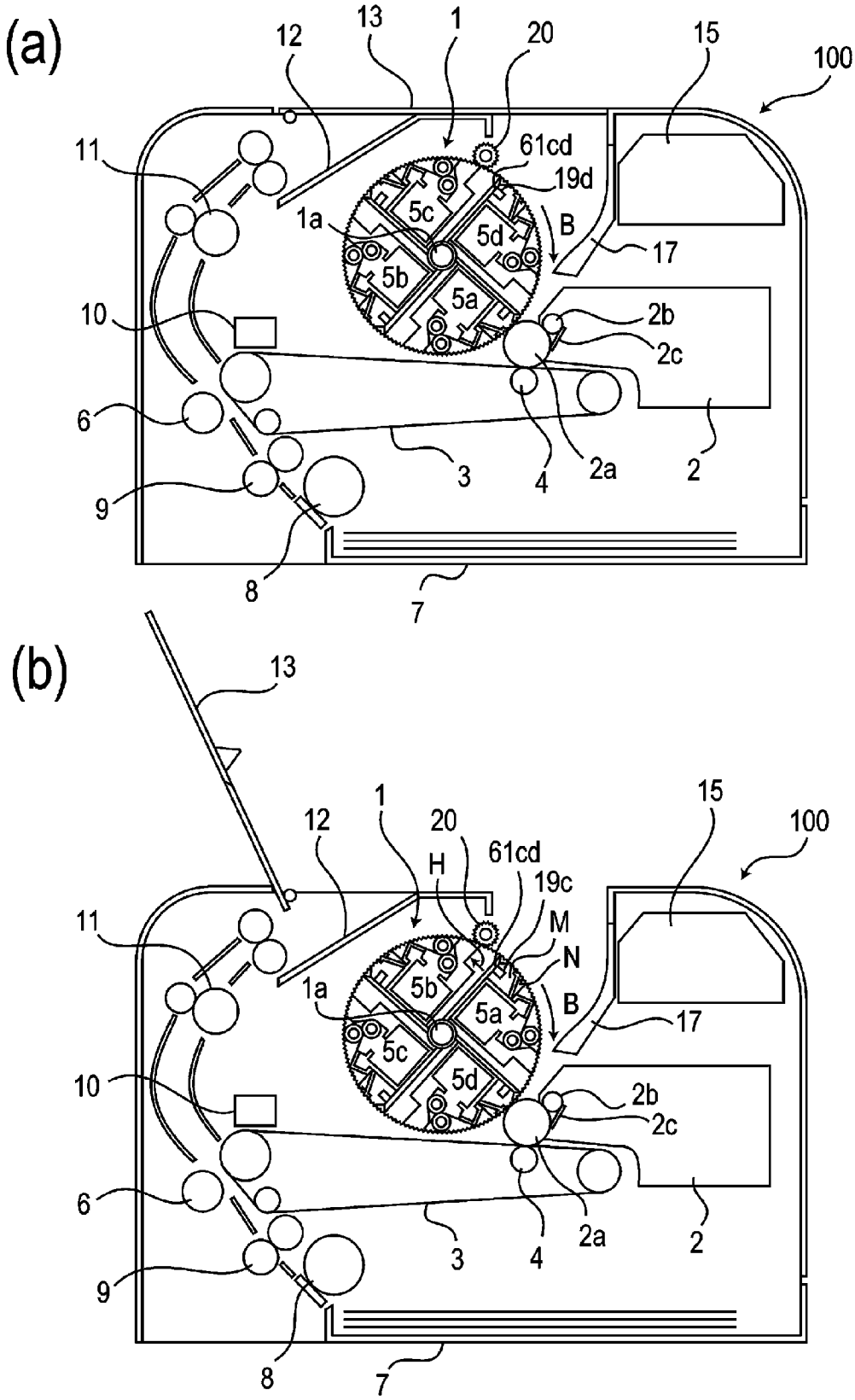
FIGS. 4(*a*) and 4(*b*) are sectional views for illustrating mounting and demounting of the developing cartridge according to the embodiment of the present invention.

FIG. 4(*a*) is a sectional view of the image forming apparatus main assembly in which the developing cartridges are in a stand-by state in which a developing operation is not performed. FIG. 4(*b*) is a sectional view of the image forming apparatus main assembly in which the yellow developing cartridge 5*a* is located at a mounting and demounting position when it is mounted and demounted.

The rotary 1 is on stand-by in the state, in which the developing operation is not performed, at a position in which the rotary 1 is rotated about the rotary rotation shaft 1*a* until a phase thereof reaches the phase in which the developing roller 51*a* is separated from the photosensitive drum 2*a*. In this embodiment, as shown in FIG. 4(*a*), the stand-by state is created at a position in which the black developing cartridge 5*d* is located about 45 degrees upstream from the developing position with respect to a rotary rotational direction B. Movement of the rotary 1 to the stand-by state (position) is automatically effected by the drive transmission mechanism after the completion of the image forming operation.

When the yellow developing cartridge 5*a* is demounted, as shown in FIG. 4(*b*), a mounting and demounting cover 13 is opened, so that the user can access the yellow developing cartridge 5*a*.

The mounting and demounting of the yellow developing cartridge 5*a* is performed in the stand-by state described above. The developing cartridge locking member 19*a* is retracted in a direction indicated by an arrow H in FIG. 4(*b*) by opening the mounting and demounting cover, thus being moved to a position in which the developing cartridge locking member 19*a* does not engage with a portion to be locked 61*ca* of the yellow developing cartridge 5*a*. As a result, only the yellow developing cartridge 5*a* located at the mounting and demounting position is disengaged from the rotary 1, so that the user can mount can demount the yellow developing cartridge 5*a* along a main assembly guide 17 by holding a grip 54 provided on the yellow developing cartridge 5*a*.

As a means for moving each of the developing cartridges to the mounting and demounting position in which the moved developing cartridge is mountable and demountable, as described above, the drive transmission mechanism in the apparatus main assembly is used but the movement of each of the developing cartridges can also be performed by directly moving the rotary 1 manually.

When the user closes the mounting and demounting cover 13, the developing cartridge locking member 19*a* is moved in an opposite direction to the arrow H direction (FIG. 4(*b*)) described above, thus being moved to a position in which the developing cartridge locking member 19*a* engages with the portion to be locked 61*ca* of the yellow developing cartridge 5*a*.

<Seal Grip Member Constitution>

The embodiment of the present invention will be described with reference to FIG. 3 and FIGS. 5 to 10.

Figure 5:
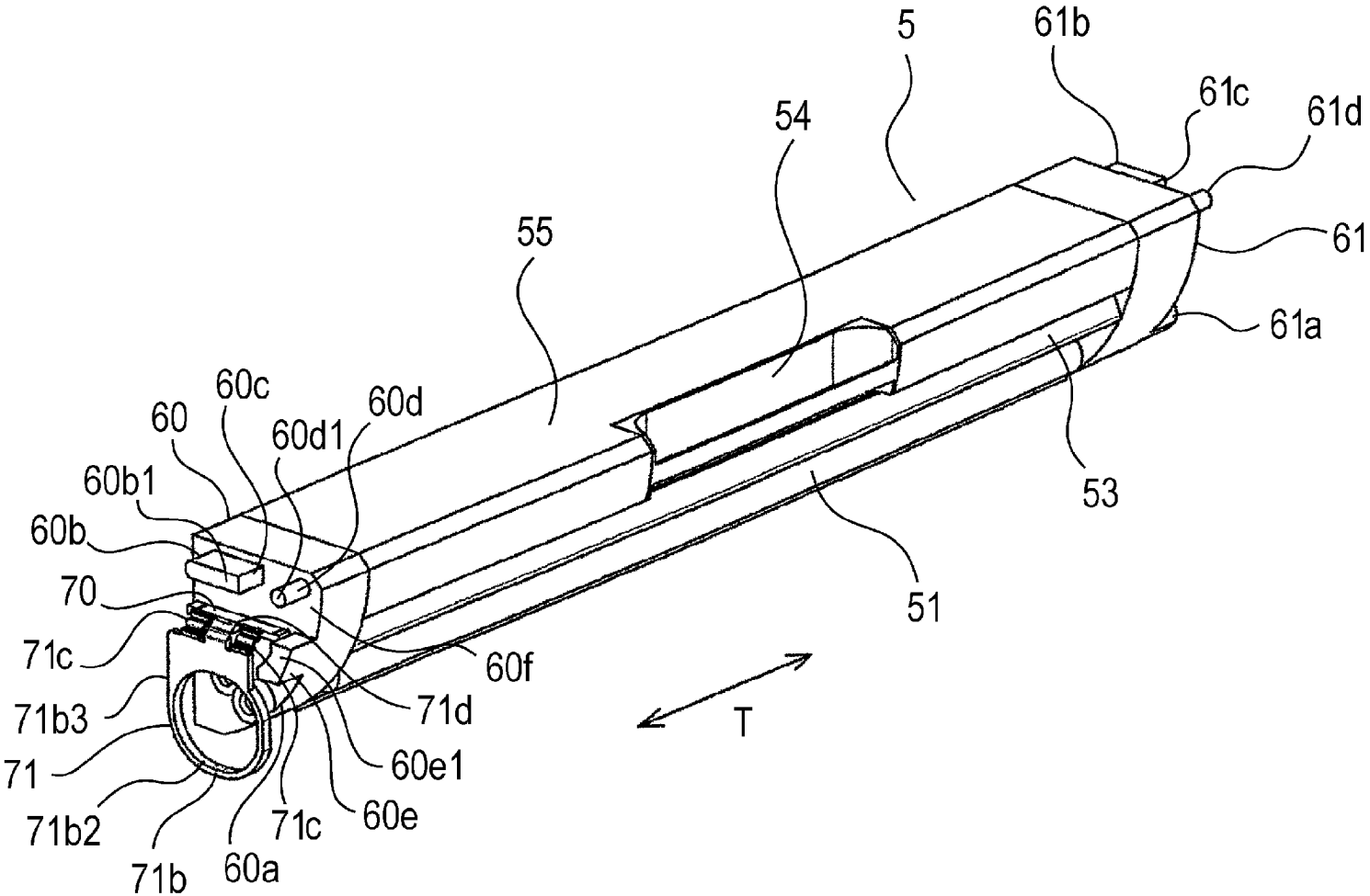
FIG. 5 is a schematic perspective view showing the developing cartridge in a shipment state according to the embodiment of the present invention.
Figure 6:
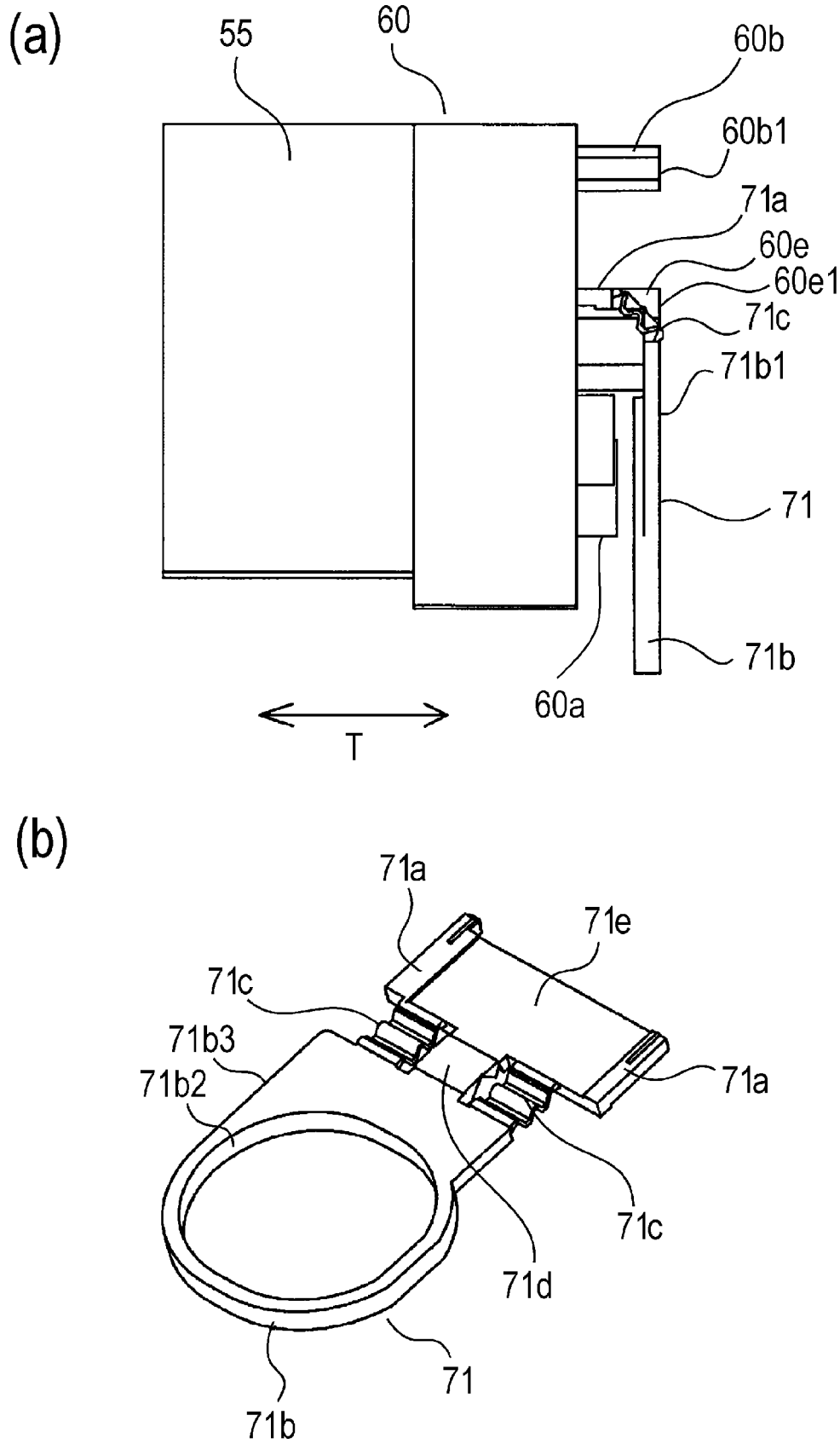
FIGS. 6(*a*) and 6(*b*) are schematic views showing a seal grip member of the developing cartridge in the shipment state according to the embodiment of the present invention.
Figure 7:
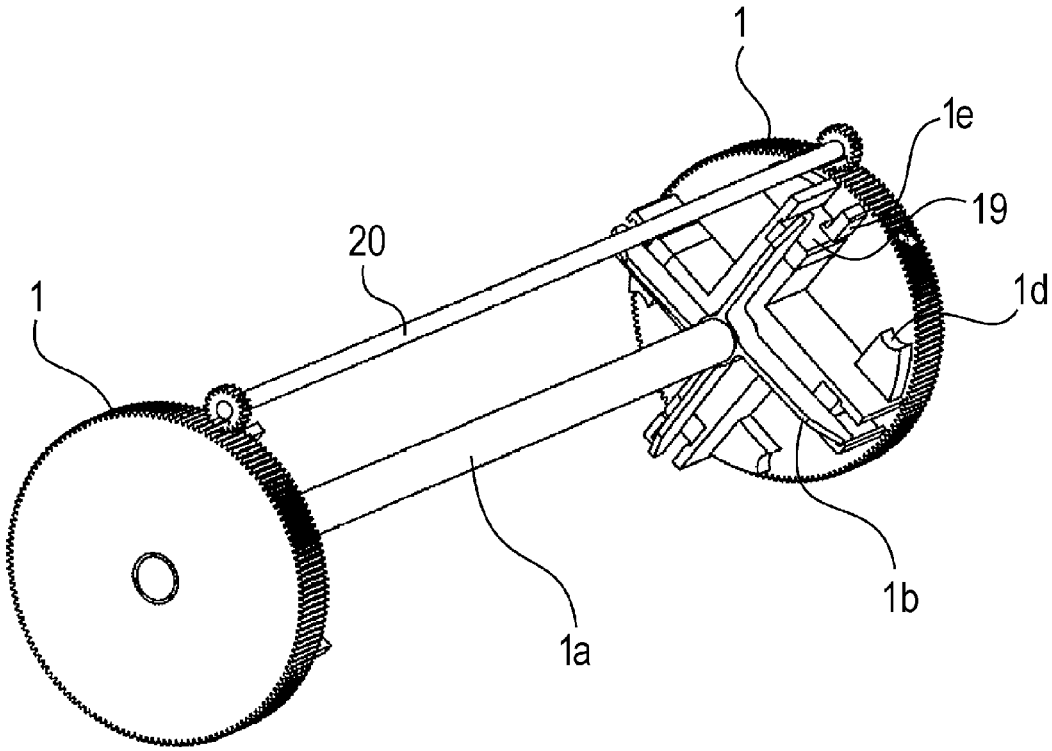
FIG. 7 is a schematic perspective view of a rotary for holding the developing cartridge according to the embodiment of the present invention.
Figure 8:
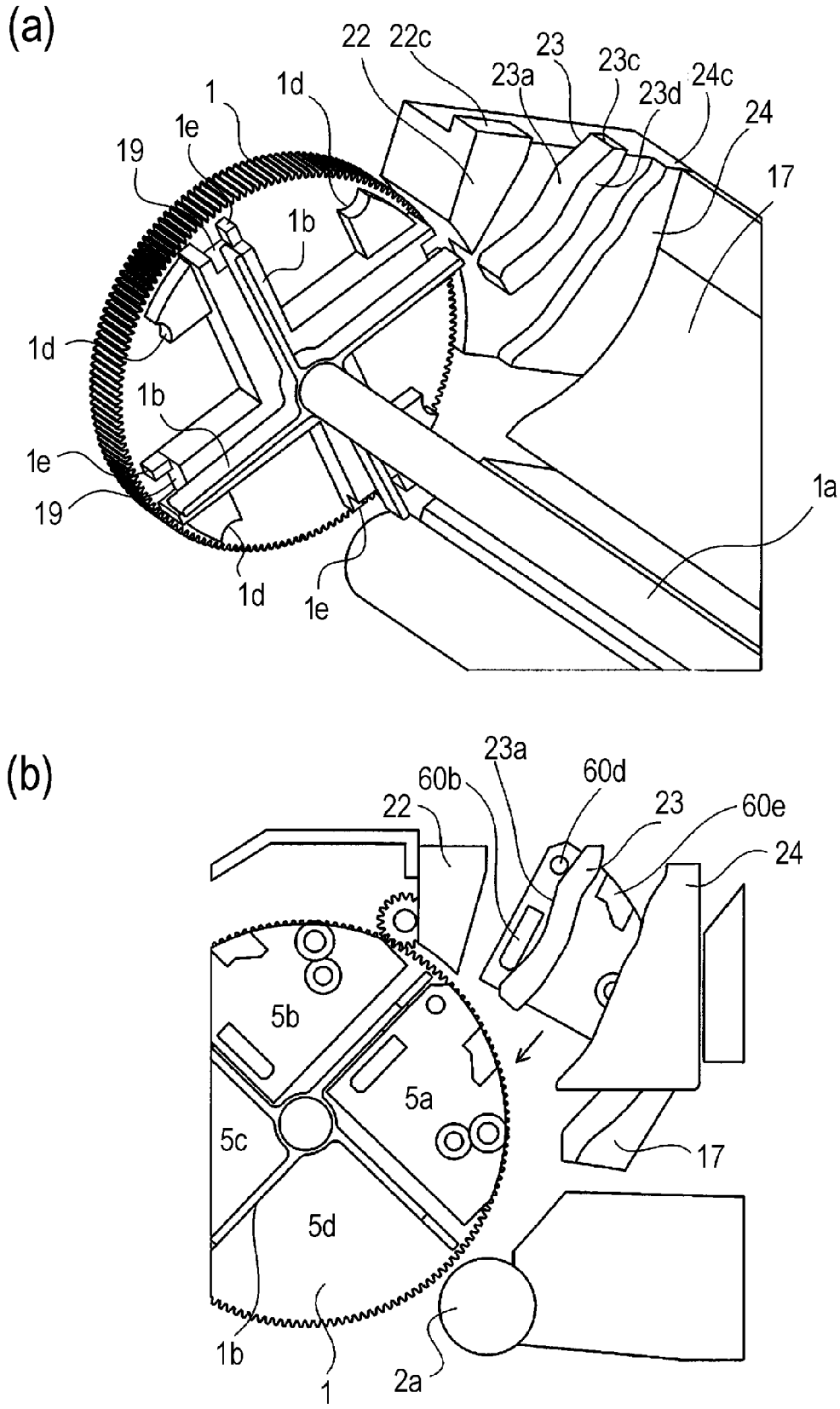
FIGS. 8(*a*) and 8(*b*) are schematic views showing a developing cartridge mounting guide according to the embodiment of the present invention.
Figure 9:
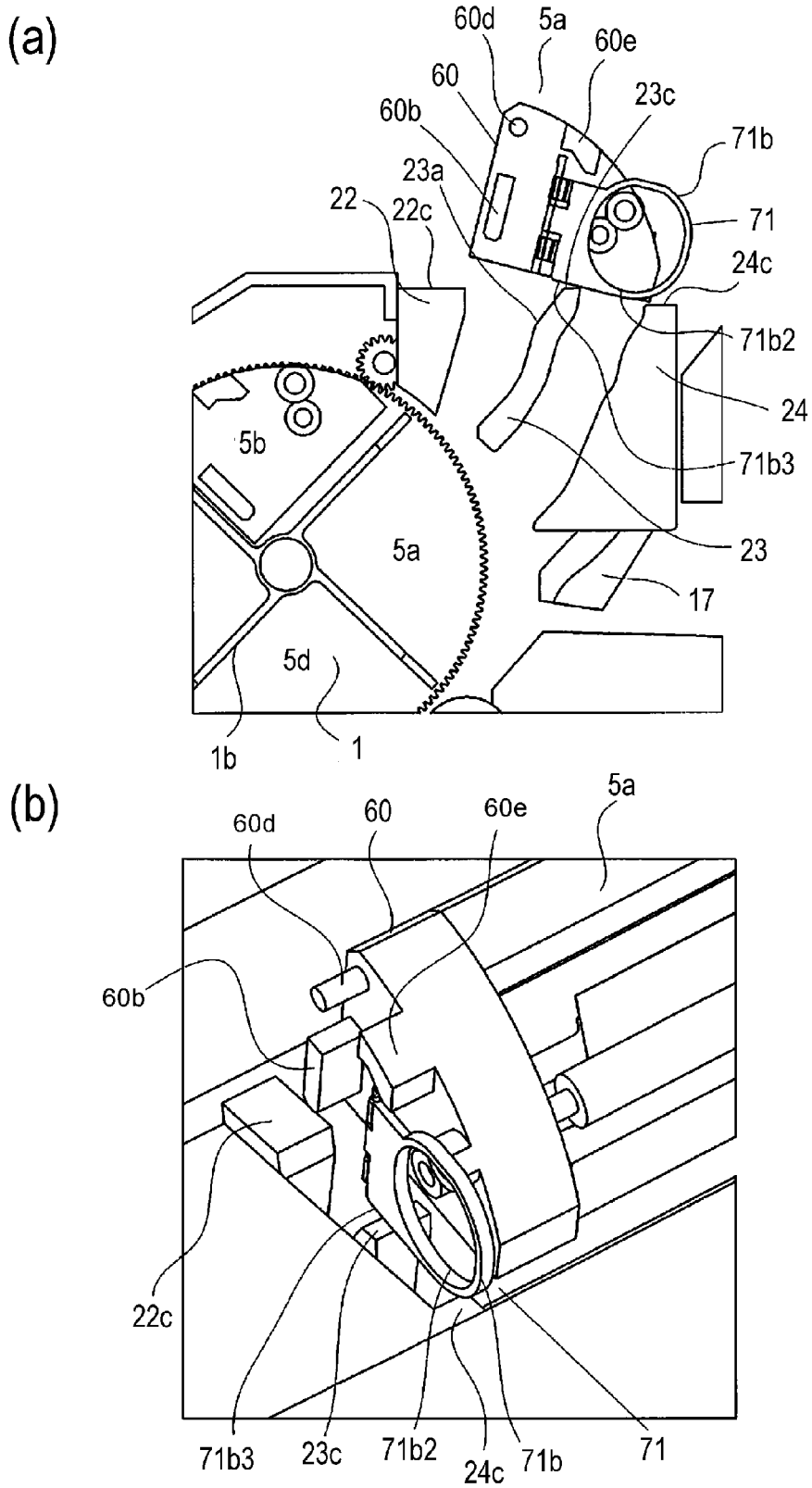
FIGS. 9(*a*) and 9(*b*) are schematic views showing a state in which the seal grip member interfere with the mounting guide in the embodiment of the present invention.
Figure 10:
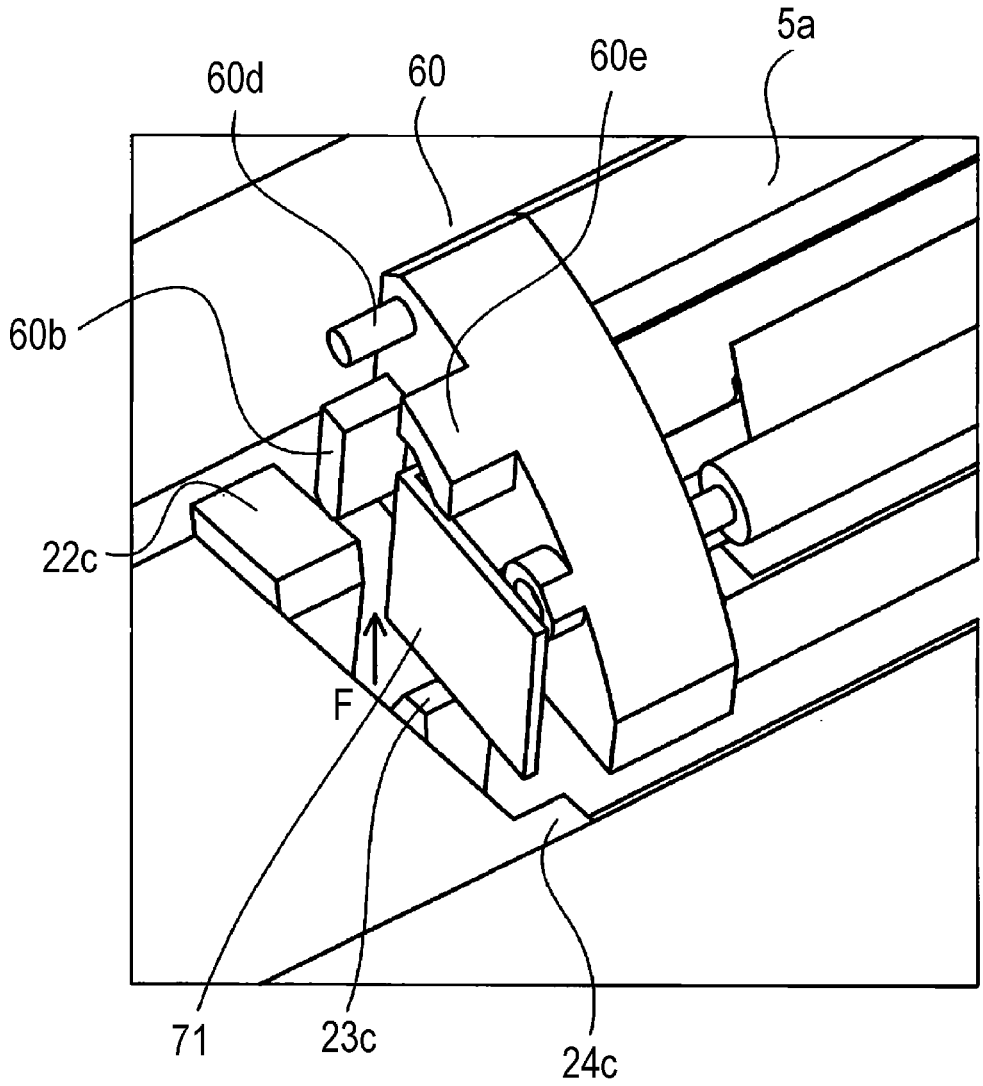
FIG. 10 is a schematic perspective view showing a developing cartridge in a state in which a conventional seal grip member interferes with a mounting guide.

FIG. 3 is a schematic perspective view of the developing cartridge before the seal grip member is bent. FIG. 5 is a schematic perspective view of the developing cartridge in the shipment state. FIG. 6(*a*) is a side view of the developing cartridge in the shipment state, and FIG. 6(*b*) is a schematic perspective view of the grip member. FIG. 7 is a schematic perspective view of the rotary for holding the developing cartridges. FIG. 8(*a*) is a schematic perspective view showing a periphery of the mounting guide at a toner seal pulling-out portion of the image forming apparatus main assembly, and FIG. 8(*b*) is a sectional view showing a state in which the yellow developing cartridge passes through the mounting guide when the yellow developing cartridge is mounted. FIG. 9(*a*) is a sectional view showing a state in which the seal grip member interferes with the mounting guide, and FIG. 9(*b*) is a perspective view showing the state in which the seal grip member interferes with the mounting guide. FIG. 10 is a perspective view showing a state in which a conventional seal grip member interferes with a mounting guide.

First, a seal grip member 71 of the developing cartridge 5 will be described with reference to FIGS. 3, 5, 6(*a*) and 6(*b*).

The seal grip member 71 as the grip member includes, as shown in FIG. 6(*b*), a fixed portion 71*a* dismountably fixed on the developing cartridge 5 and a grip portion 71*b* for being gripped (held) by the user. Further, the seal grip member 71 includes thin hinge portions 71*c* and 71*d*, disposed between the fixed portion 71*a* and grip portion 71*b*, for bending the grip portion 71*b* relative to the fixed portion 71*a*, and includes a seal fixing surface 71*e* for fixing the toner seal 70.

Further, the fixed portion 71*a* and the seal fixing surface 71*e* are integrally constituted. At one side end portion of the seal fixing surface 71*e*, the toner seal 70 is fixed, and at the other end portion of the seal fixing surface 71*e*, the grip portion 71*b* is provided via the hinge portions 71*c* and 71*d*. Incidentally, in this embodiment, one end of the toner seal 70 is fixed on the seal fixing surface 71*e* by the welding but may also be fixed by an adhesive, a double-sided tape, or the like.

Further, the seal grip member 71 is, as shown in FIG. 6(*a*), fixed at the toner pulling-out portion by press-fitting the fixed portion 71*a* into an end surface of the developing devised frame 55 or in a part of the side member 60. With respect to the fixing method, any method other than the press-fitting method so long as a similar effect can be obtained. At this time, the fixed portion 71*a* is substantially parallel to a line connecting centers of the projected portions 60*b* and 50*d* (FIG. 5). That is, although described later, during the mounting, the developing cartridge 5 is mounted in the rotary 1 while the projected portions 60*b* and 60*d* as the portion to be guided are guided by a mounting guide 23 (FIG. 8(*a*)) which is engaged with the projected portions 60*b* and 60*d* and guides the mounting and demounting of the developing cartridge 5. That is, the developing cartridge is mounted in and demounted from the image forming apparatus main assembly by being passed through the mounting guide. For this reason, the fixed portion 71*a* is in a state in which the fixed portion 71*a* is substantially parallel to the mounting direction.

Next, packing of the developing cartridge 5 will be described. When the seal grip member 71 is attached to the developing cartridge 5, as shown in FIG. 3, the attaching is performed in a state in which the grip portion 71*b* is not bent. Thereafter, the grip portion 71*b* is pushed in a bending direction, so that the grip portion 71*b* is disposed in a state in which the grip portion 71*b* is bent in a direction crossing the cartridge mounting direction. As a result, the attitude of the seal grip member 71 is, as shown in FIGS. 5, 6(*a*) and 6(*b*), held in a state in which the grip portion 71*b* is bent at an angle of about 90 degrees to about 110 degrees with the hinge portions (bending portions) 71*c* and 71*d* as the (bending) center. At this time, an outermost portion 71*b*1 of the seal grip member 71 in the bent state with respect to the longitudinal direction is in a state in which the portion 71*b*1 is substantially aligned with or closer to the side member 60 than end surfaces 60*b*1, 60*d*1 and 60*e*1 of the projected portions 60*b*, 60*d* and 60*e* to be guided by the mounting guides 22, 23 and 24. For this reason, when the grip portion 71*b* is provided, the developing cartridge 5 is not increased in size with respect to a developing roller axial direction T.

Further, the grip member 71 is protected by being prevented from being projected more outward than the end surfaces 60*b*1, 60*d*1 and 60*e*1 of the projected portions 60*b*, 60*d* and 60*e* with respect to the developing cartridge. Further, in a step of hermetically packing the developing cartridge in a bag, the seal grip member 71 does not interfere with the bag to prevent trouble in the step. In this embodiment, positions of the end surfaces 60*b*1, 60*d*1 and 60*e*1 of the projected portions 60*b*, 60*d* and 60*e* are substantially aligned with each other but may also be not aligned with each other. Even in the latter case, a similar effect can be achieved when the outermost portion 71*b*1 of the seal grip member 71 in the bent state is substantially aligned with or closer to the side member 60 than the most projected portion.

<Insertion of Developing Cartridge and Relationship Between Developing Cartridge and Grip Portion >

Next, a relationship between the developing cartridge 5 and the grip member when the developing cartridge 5 is mounted in the image forming apparatus 100 will be described. Incidentally, in this case, the case where the yellow developing cartridge 5*a* is mounted will be described as an example but other developing cartridges can also be described similarly.

As shown in FIGS. 8(*a*) and 8(*b*), the yellow developing cartridge 5*a* is mounted so that the projected portions 60*b* and 60*d* (FIG. 5) passes between the mounting guides 22 and 23 and so that the projected portion 60*e* (FIG. 5) passes between the mounting guides 23 and 24. Thereafter, the projected portions 60*b* and 60*d* are moved along a guide surface 23*a* of the mounting guide 23 and is mounted into the rotary 1. At this time, an end surface 60*f* of the side member 60 of the yellow developing cartridge 5*a* is in an opposed state with a spacing of 0-2 mm.

Thereafter, the yellow developing cartridge 5*a* is guided to a predetermined position by a partition plate 1*b* for partitioning the rotary 1 into four 90 degree-sections. Further, the rotary 1 includes a positioning portion 1*d* in order to position the yellow developing cartridge 5*a*.

The yellow developing cartridge 5 is positioned by abutting outer circumferential portions of axis portions 60*a* and 61*a* (FIG. 3), of the side members 60 and 61 fixed on the both end portions of the developing cartridge 5, against the positioning portion 1*d*. Further, the projected portions 60*d* and 61*d* rotate about the axis portions 60*a* and 61*a* when the yellow developing cartridge 5*a* is driven, so that the projected portions 60*d* and 61*d* abut a against a rotation preventing portion le and their attitudes in the rotary 1 are determined. In this embodiment, the axis portions 60*a* and 61*a* are coaxially located with respect to the developing roller 51 but are not required to be particularly restricted.

Next, the case where the user intends to mount the yellow developing cartridge 5*a* into the image forming apparatus main assembly without removing the toner seal 70 will be described with reference to FIGS. 9(*a*) and 9(*b*).

In the case where the yellow developing cartridge 5*a* is mounted while attaching the seal grip member 71 placed in the bent state, as shown in FIG. 9(*a*), the grip portion 71*b* of the seal grip member 71 interferes with an upper surface (inlet portion) 23*c* of the mounting guide 23. By this interference, the user can recognize that the toner seal 70, i.e., the seal grip member has not been removed. Depending on the attitude or position of the yellow developing cartridge 5*a*, the grip portion 71*b* can interfere with upper surfaces (inlet portions) 22*c* and 24*c* of the mounting guides 22 and 24. Thus, a part of the bent grip portion contacts a part of the image forming apparatus main assembly, so that the mounting of the developing cartridge into the image forming apparatus main assembly is prevented.

As described above, when the user intends to mount the developing cartridge into the image forming apparatus without removing the toner seal member 71, the grip portion 71*b* contacts the mounting guide to prevent the developing cartridge from being mounted into the image forming apparatus. As a result, the user who has recognized that the seal grip member 71 was not removed grips the grip portion 71*b* and pulls the grip portion 71*b* in the longitudinal direction in a state in which the bending of the seal grip member 71 is released (FIG. 3), so that the toner seal 70 is removed.

An advantage of the above-described interference of the grip portion 71*b* is that the grip portion 71*b* is provided with a hole 71*b*2 for cueing the user to insert his (her) fingers into the hole 71*b*2 when the user grips the grip portion 71*b*, so that the grip portion 71*b* itself is deformed when the neighborhood of the hole 71*b*2 interferes with the mounting guide. For this reason, even when the grip portion 70*b* interferes with the mounting guide, the fixed portion 71*a* is less liable to be dismounted from the yellow developing cartridge 5*a*. Further, when a plate-like portion 71*b*3 of the grip portion 71*b* interferes with the mounting guide, the deformation of the grip portion 71*b* does not directly lead to deformation of the fixed portion 71*a* due to interposition of the hinge portions 71*c* and 71*d* which are the thin portion. For this reason, the fixed portion 71*a* is less liable to be dismounted from the yellow developing cartridge 5*a*. For that reason, even in the case where the seal grip member 71 causes the interference, the seal grip member 71 is less liable to be disconnected from the yellow developing cartridge 5*a*.

For example, the case where the seal grip member 71 is not provided with the hole or the hinge portion as in the seal grip member 71 shown in FIG. 10 will be described. In this case, when the direction of the fixed portion 71*a* is set so as to be parallel to the mounting direction, the seal grip member 71 receives a force with respect to a direction indicated by an arrow F when the yellow developing cartridge 5*a* is mounted into the image forming apparatus main assembly and thus the seal grip member 71 interferes with the mounting guide. This force is directly transmitted to the fixed portion, so that the seal grip member 71 is liable to be disconnected from the yellow developing cartridge 5*a*.

In this embodiment, the drum cartridge 2 including at least the photosensitive drum 2*a* and the charging roller 2*b*, and the developing cartridge 5 including at least the developing roller have independent constitutions. However, also in the case of the process cartridge in which the drum cartridge 2 and the developing cartridge 5 are integrally supported, a similar effect can be obtained by providing the seal grip member below the projected portion to be guided by the mounting guide.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 249750/2009 filed Oct. 30, 2009, which is hereby incorporated by reference.

What is claimed is:

1. A developing cartridge detachably mountable to a main assembly of an image forming apparatus by passing through a mounting guide provided in the main assembly, said developing cartridge comprising:

a frame;

a developer carrying member for carrying a developer for developing an electrostatic latent image;

a portion to be guided by the mounting guide;

an accommodating portion for accommodating the developer;

a seal member for sealing an opening that permits supply of the developer from said accommodating portion to said developer carrying member; and a grip member, provided at a longitudinal end portion of said seal member, including a grip portion to be gripped when said seal member is removed, wherein said grip portion is disposed in a state in which said grip portion is bent in a direction crossing a mounting direction of said developing cartridge, and wherein said grip portion prevents mounting of said developing cartridge by contacting a part of the mounting guide when said developing cartridge is mounted in the main assembly of the image forming apparatus, the part of the mounting guide being an upper surface of the mounting guide.

2. A developing cartridge according to claim 1, wherein. said grip member includes a fixed portion, acid also includes a bent portion, between said fixed portion and said grip portion, for permitting bending of said grip portion relative to said fixed portion.

3. A developing cartridge according to claim 1, wherein said grip portion is provided with a hole.

4. developing cartridge according to claim 1, wherein said grip portion of said grip member is, in the state in which said grip portion is bent, located inside said portion to be guided with respect to an axial direction of said developer carrying member.

5. A developing cartridge according to claim 1, wherein the part of the mounting guide is an inlet portion of the mounting guide.

6. A process cartridge detachably mountable to a main assembly of an image forming apparatus by passing through a mounting guide provided in the main assembly, said process cartridge comprising:

an image bearing member on which an electrostatic latent image is to be formed;

a frame;

a developer carrying member for carrying a. developer for developing the electrostatic latent image;

a portion to be guided for being guided by the mounting guide;

an accommodating portion for accommodating the developer;

a seal member for sealing an opening that permits supply of the developer from said accommodating portion to said developer carrying member; and a grip member, provided at a longitudinal end portion of said seal member, including a grip portion to be gripped when said seal member is removed, wherein said grip portion is disposed in a state in which said grip portion is bent in a direction crossing a mounting direction of said process cartridge, and wherein said grip portion prevents mounting of said process cartridge by contacting a part of the mounting guide when said process cartridge is mounted in the main assembly of the image forming apparatus, the part of the mounting guide being an upper surface of the mounting guide.

7. A process cartridge according to claim 6, wherein said grip member includes a fixed portion, and also a bent portion, between said fixed portion and said grip portion, for permitting bending of said grip portion relative to said fixed portion.

8. A process cartridge, according to claim 6, wherein said grip portion provided with a hole.

9. A process cartridge according to claim 6, wherein said grip portion of said grip member is, in the state in which said grip portion is bent, located inside said portion to be guided with respect to an axial direction of said developer carrying member.

10. A process cartridge according to claim 6, wherein the part of the mounting guide is an inlet portion of the mounting guide.

11. A developing cartridge detachably mountable to a main assembly of an image forming apparatus by passing through a mounting guide provided in the main assembly, said developing cartridge comprising:

a frame;

a developer carrying member for carrying a developer for developing an electrostatic latent image;

a portion to be guided by the mounting guide when said developing cartridge passes through the mounting guide;

an accommodating portion for accommodating the developer;

a seal member for sealing an opening that permits supply of the developer from said accommodating portion to said developer carrying member; and a grip member, provided at a longitudinal end portion of said seal member, including a fixed portion dismountably fixed on said frame and a grip portion to be gripped when said seal member is removed, wherein said grip portion is disposed in a state in which said grip portion is bent relative to the fixed portion in a direction crossing a mounting direction of said developing cartridge, wherein said grip portion prevents mounting of said developing cartridge by contacting a part of the image forming apparatus when said developing cartridge is mounted in the main assembly of the image forming apparatus, and wherein said grip portion is, in the state in which said grip portion is bent, located inside said portion to he guided with respect to an axial direction of said developer carrying member.

12. A developing cartridge according to claim 11, wherein said grip member includes a bent portion, between said fixed portion and said grip portion, for permitting bending of said grip portion relative to said fixed portion.

13. A developing cartridge according to claim 11, wherein said grip portion is provided with a hole.

14. A developing cartridge according to claim 11, wherein the part of the image forming apparatus is an inlet portion of the mounting guide.

15. A developing cartridge according to claim 11, wherein the part of the mounting guide is an upper surface of the mounting guide.

16. A process cartridge detachably mountable to a main assembly of an image forming apparatus by passing through a mounting guide provided in the main assembly, said process cartridge comprising:

an image bearing member on which an electrostatic latent image is to he formed;

a frame;

a developer carrying member for carrying a developer for developing the electrostatic latent image;

a portion-to-be-guided by the mounting guide when said process cartridge passes through the mounting guide;

an accommodating portion for accommodating the developer;

a seal member for unsealably sealing an opening for permitting supply of the developer from said accommodating portion to said developer carrying member; and a grip member, provided at a longitudinal end portion of said seal member, including a fixed portion dismountably fixed on said frame and a grip portion to be gripped when said seal member is removed, wherein said grip portion is disposed in a state. in which said grip portion is bent relative to the fixed portion in a direction crossing a mounting direction of said process cartridge, and wherein said grip portion prevents mounting of said process cartridge by contacting a part of the image forming apparatus when said process cartridge is mounted in the main assembly of the image forming apparatus, and wherein said grip portion is, in the state in which said grip portion is bent, located inside said portion to be guided with respect to an axial direction of said developer carrying member.

17. A process cartridge according to claim 16, wherein said grip member includes a bent portion, between said fixed portion and said grip portion, for permitting bending of said grip portion relative to said fixed portion.

18. A process cartridge according to claim 16, wherein said grip portion is provided with a hole.

19. A process cartridge according to claim 16, wherein the part of the image forming apparatus is an inlet portion of the mounting guide.

20. A developing cartridge according to claim 16, wherein the part of the mounting guide is an upper surface of the mounting guide.

21. A developing cartridge detachably mounted to a main assembly of an image forming apparatus by passing through a mounting guide provided in the main assembly, said developing cartridge comprising:

a frame;

a developer carrying lumber for carrying a developer for developing an electrostatic latent image;

a portion to be guided by the mounting guide when said developing cartridge passes through the mounting guide;

an accommodating portion for accommodating the developer;

a seal member for sealing an opening that permits supply of the developer from said accommodating portion to said developer carrying member; and a grip member, provided at a longitudinal end portion of said seal member, including a fixed portion dismountably fixed on said frame and a grip portion to be gripped when said seal member is removed, wherein said grip portion is disposed in a state in which said grip portion is bent relative to the fixed portion in a direction crossing a mounting direction of said developing cartridge, wherein said grip portion prevents mounting of said developing cartridge by contacting a part of the image forming apparatus when said developing cartridge is mounted in the main assembly of the image forming apparatus, and wherein said grip portion, in a state in which said grip portion is bent, is located inside an extent of said portion to he guided in an axial direction of said developer carrying member.

22. A developing cartridge detachably mountable to a main assembly of an image forming apparatus by passing through a mounting guide provided in the main assembly, said developing cartridge comprising:

a frame;

a developer carrying member for carrying a developer for developing an electrostatic latent image;

a portion to be guided by the mounting guide when said developing cartridge passes through the mounting guide;

an accommodating portion for accommodating the developer;

a seal member for sealing an opening that permits supply of the developer from said accommodating portion to said developer carrying member; and a grip member, provided at a longitudinal end portion of said seal member, including a fixed portion dismountably fixed on said frame and a grip portion to be gripped when said seal member is removed, wherein said grip portion is disposed in a state in which said grip portion is bent relative to the fixed portion in a direction crossing a mounting direction of said developing cartridge, wherein said grip portion prevents mounting of said developing cartridge by contacting a part of the image forming apparatus when said developing cartridge is mounted in the main assembly of the image forming apparatus, and wherein, in the state in which said grip portion is bent, an extent of said grip portion in the direction crossing the mounting direction is equal to or less than an extent of said portion to be guided in the direction crossing the mounting direction.

* * * * *